US008308166B2

(12) United States Patent
Cho

(10) Patent No.: US 8,308,166 B2
(45) Date of Patent: Nov. 13, 2012

(54) SINGLE LOOP NET WITH PEGS

(76) Inventor: Kwang Han Cho, Northridge, CA (US)

( * ) Notice: Subject to any disclaimer, the term of this patent is extended or adjusted under 35 U.S.C. 154(b) by 179 days.

(21) Appl. No.: 12/900,134

(22) Filed: Oct. 7, 2010

(65) Prior Publication Data

US 2012/0088594 A1 Apr. 12, 2012

(51) Int. Cl.
*A63B 63/00* (2006.01)

(52) U.S. Cl. ..... 273/401; 473/197; 473/454; 473/478

(58) Field of Classification Search ..... 273/398–402, 273/395, 396; 473/476, 478, 434, 435, 545, 473/456

See application file for complete search history.

(56) References Cited

U.S. PATENT DOCUMENTS

| | | | | |
|---|---|---|---|---|
| 5,569,094 | A * | 10/1996 | Macaluso | 473/197 |
| 6,135,894 | A * | 10/2000 | Cho | 473/197 |
| 6,165,085 | A * | 12/2000 | Lubin | 473/478 |
| 6,514,149 | B2 * | 2/2003 | Yoon | 473/197 |
| 6,517,444 | B1 * | 2/2003 | Yoon | 473/197 |
| 6,543,776 | B2 * | 4/2003 | Macaluso | 273/400 |
| 6,716,122 | B2 * | 4/2004 | Vermeulen | 473/476 |
| 6,939,241 | B1 * | 9/2005 | Chang | 473/197 |
| 6,991,567 | B2 * | 1/2006 | Wong et al. | 473/478 |
| 7,021,630 | B1 * | 4/2006 | Cho | 273/401 |
| 7,198,274 | B2 * | 4/2007 | Cho | 273/400 |
| 7,264,245 | B2 * | 9/2007 | Cho | 273/396 |
| 7,543,821 | B2 * | 6/2009 | Winningham et al. | 273/396 |
| 7,651,098 | B2 * | 1/2010 | Cho | 273/400 |
| 7,731,198 | B2 * | 6/2010 | Cho | 273/396 |
| 7,744,089 | B2 * | 6/2010 | Huang | 273/400 |
| 2001/0006074 | A1 * | 7/2001 | Zheng | 135/126 |
| 2002/0030324 | A1 * | 3/2002 | Macaluso | 273/400 |
| 2002/0058556 | A1 * | 5/2002 | Zheng | 473/471 |

* cited by examiner

*Primary Examiner* — Mark Graham

(74) *Attorney, Agent, or Firm* — John K. Park; Park Law Firm

(57) ABSTRACT

A single loop net includes a loop member, triangular holders, side straight edge portions, two propping poles, two holding straps, a first opening, a catching net, net deploying straps, and a second opening. The triangular holders are for holding two neighboring straight portions. The side straight edge portions are fixed to one of the side straight portions. Each of the propping poles extends from two side straight portions of the loop member. Each of the holding straps extends from a lower portion of the loop member. The first opening is enclosed and defined by the triangular holders and the side straight edge portions. The catching net covers the first opening and configured to catch balls flying into the first opening from a frontal direction. The second opening is disposed in a bottom one of the side straight edge portions. The second opening is disposed so as to return balls.

20 Claims, 10 Drawing Sheets

SINGLE LOOP NET WITH PEGS

BACKGROUND OF THE INVENTION

The present invention relates to a single loop net for use in various sports such as baseball, golf, etc. More specifically, the present invention relates to a single loop net, which is easy to set up.

SUMMARY OF THE INVENTION

The present invention aims to provide a portable, lightweight, and easy to use exercise platform by which users can practice various sports activities.

An aspect of the present invention provides a ball net of box type with raised front top.

The single loop net comprises a loop member, a plurality of triangular holders, a plurality of side straight edge portions, two propping poles, two holding straps, a first opening, a catching net, one or more net deploying straps, and a second opening.

The loop member comprises a plurality of side straight portions and a plurality of curved corner portions.

The plurality of triangular holders are for holding two neighboring straight portions having one of the plurality of corner portions inbetween so as to form a predetermined angle between the two neighboring straight portions.

The plurality of side straight edge portions are fixed to one of the plurality of side straight portions and disposed between and engaging parts of two neighboring triangular holders.

Each of the one or more propping poles extends from two side straight portions of the loop member, and comprises a first end detachably fixed to the side straight portion and a second end detachably fixed to a location on ground.

Each of the one or more holding straps extends from a lower portion of the loop member, and comprises a holding hole at an end thereof, which is configured to accept the second end of the propping pole.

The first opening is enclosed and defined by the triangular holders and the side straight edge portions.

The catching net covers the first opening from behind and configured to catch balls flying into the first opening from a frontal direction.

Each of the one or more net deploying straps comprises a first end fixing to and extending from a portion of the catching net and a second end configured to be fixed a location on ground. The one or more net deploying straps are configured to pull the catching net toward one or more rear directions so as to provide one or more tilted surfaces along the catching net, and comprise a bottom tilted surface tilted toward a frontal direction.

The second opening is disposed in a bottom one of the plurality of side straight edge portions. The second opening is disposed so as to return balls falling down on the bottom tilted surface toward a frontal direction, and the one or more tilted surfaces of the catching net are configured to collect and guide balls to the second opening.

The loop member may be coilable such that the loop member is coiled and packed into a smaller ring.

The loop member may comprise four side straight portions and four curved corner portions.

Each of the plurality of triangular holders may be made of fabric. Each of the plurality of side straight edge portions may be made of fabric.

The loop member may be embedded in fabric edge holes disposed along edges of the plurality of triangular holders and the plurality of side straight edge portions.

Each of the propping poles may comprise two or more section poles configured to be connected and detachably fixed to form a propping pole which is configured to support the loop member against gravity.

The first end of the propping pole may be fixed to a receiving hole provided in one of the plurality of side straight edge portions.

The single loop net may further comprise one or more propping pole wrapping straps, and each of the one or more propping pole wrapping straps may comprise first and second ends, a supporting hole, and a middle cutout.

The first end may be fixed to one of the plurality of side straight edge portions.

The second end may be configured to detachably hold the second end of the propping pole.

The supporting hole may be configured for receiving the section poles of the propping pole.

The middle cutout may be configured for receiving the section poles of the propping pole.

The second end of each of the propping pole wrapping straps may be connected to the second end of the corresponding holding straps.

The single loop net may further comprise a plurality of pegs for fixing the holding straps, propping pole wrapping straps, and the net deploying straps to the ground.

The single loop net may further comprise a perimeter portion extends from inner edges of the triangular holders and the side straight edge portions, and the perimeter portion may have a color different from the triangular holders and the side straight edge portions so as to make the first opening outstanding visually.

The top and side edge portions of the catching net may be fixed to inner portions of the triangular holders and the side straight edge portions.

The bottom edge portions of the catching net may be fixed to a bottom portion of the second opening.

The single loop net can be deployed and maintained easily due to the inventive structure.

Another aspect of the invention provides a single loop net.

The single loop net comprises:

a loop member comprising a plurality of side straight portions and a plurality of curved corner portions;

a plurality of triangular holders for holding two neighboring straight portions having one of the plurality of corner portions inbetween so as to form a predetermined angle between the two neighboring straight portions;

a plurality of side straight edge portions fixed to one of the plurality of side straight portions and disposed between and engaging parts of two neighboring triangular holders;

two propping discs, each of which comprising a first side portion configured for engaging a lower portion of the loop member and a second side portion configured for being fixed on a ground and propping the single loop net, wherein the first side portion meets the second side portion with a predetermined angle, which is less than a right angle;

a first opening enclosed and defined by the triangular holders and the side straight edge portions;

a catching net covering the first opening from behind and configured to catch balls flying into the first opening from a frontal direction;

one or more net deploying straps, each of which comprising a first end fixing to and extending from a portion of the catching net and a second end configured to be fixed a location on ground, wherein the one or more net deploying straps are configured to pull the catching net toward one or more rear directions so as to provide one or more tilted surfaces along the catching net, wherein the one or more tilted surfaces comprise a bottom tilted surface tilted toward a frontal direction;

a second opening disposed in a bottom one of the plurality of side straight edge portions, wherein the second opening is disposed so as to return balls falling down on the bottom tilted surface toward a frontal direction, wherein the one or more tilted surfaces of the catching net are configured to collect and guide balls to the second opening.

Each of the two propping discs may be detachably attached to the lower portion of the loop member.

Each of the two propping discs may be detachably attached to the lower portion of the loop member with a portion of the side straight edge portion.

Each of the two propping discs may be fixed to the ground by a plurality of pegs.

Each of the two propping discs may further comprise a third side portion which meets the first and second side portions so as to form a triangle.

Each of the two propping discs may be substantially rigid so as to prop the single loop net on the ground, and wherein the loop member is callable.

Still another embodiment of the invention provides a single loop net.

The single loop net comprises a loop member, an edge portion, one or more propping poles, one or more holding straps, a first opening, a catching net, one or more net deploying straps, and a second opening.

The loop member may have an arbitrary shape such as a circle and polygons.

The edge portion encloses and is fixed to the loop member.

Each of the one or more propping poles extends from two side positions of the loop member, and each of the one or more propping poles comprises a first end detachably fixed to the side position of the loop member and a second end detachably fixed to a location on ground.

Each of the one or more holding straps extends from a lower portion of the loop, member, and each of the one or more holding straps comprises a holding hole at an end thereof, which is configured to accept the second end of the propping pole.

The first opening is enclosed and defined by the edge portion.

The catching net covers the first opening from behind and is configured to catch balls flying into the first opening from a frontal direction.

Each of the one or more net deploying straps comprises a first end fixing to and extending from a portion of the catching net and a second end configured to be fixed a location on ground, and the one or more net deploying straps are configured to pull the catching net toward one or more rear directions so as to provide one or more tilted surfaces along the catching net, and the one or more tilted surfaces comprise a bottom tilted surface tilted toward a frontal direction.

The second opening is disposed in a lower portion of the edge portion, and the second opening is disposed so as to return balls falling down on the bottom tilted surface toward a frontal direction, and the one or more tilted surfaces of the catching net are configured to collect and guide balls to the second opening. The loop member may be coilable.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
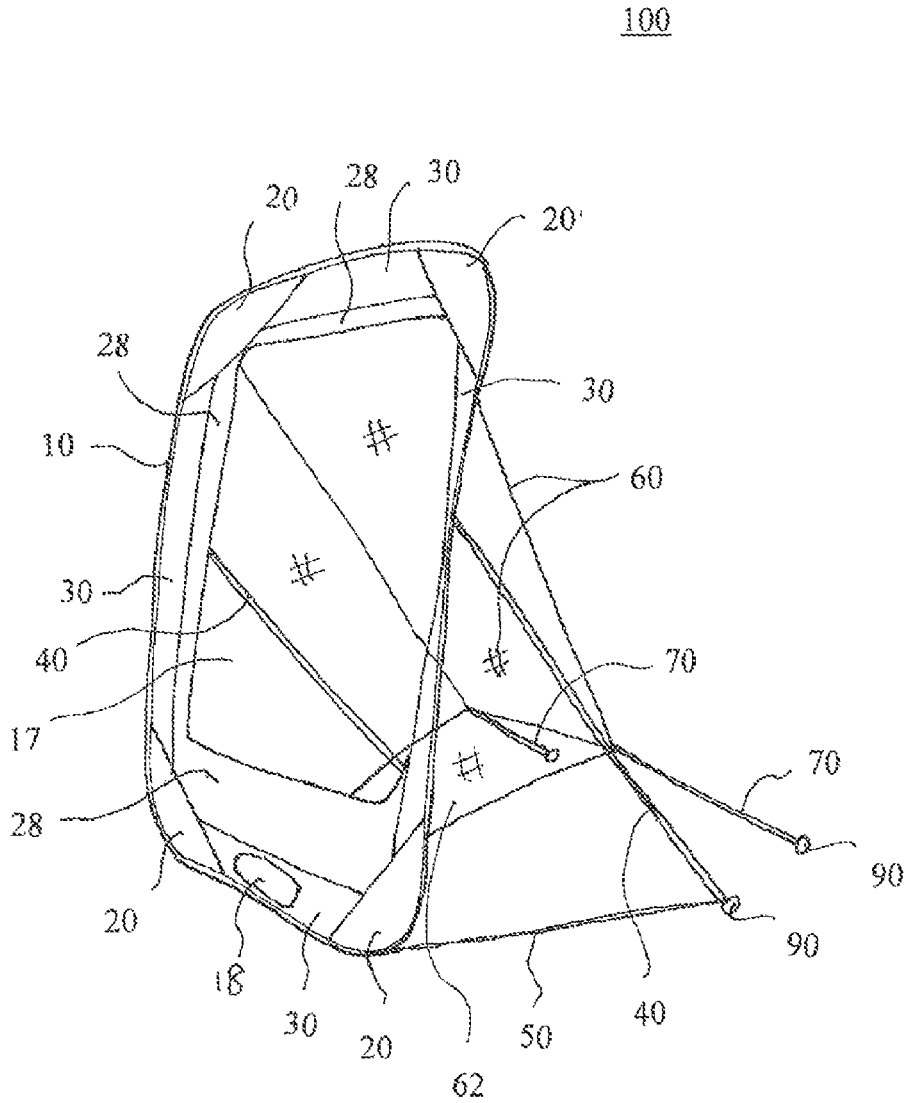
FIG. 1 is a perspective view of a single loop net according to an embodiment of the invention.

An aspect of the present invention provides a single loop net 100 as shown in FIGS. 1-4.

The single loop net 100 comprises a loop member 10, a plurality of triangular holders 20, a plurality of side straight edge portions 30, two propping poles 40, two holding straps 50, a first opening 17, a catching net 60, one or more net deploying straps 70, and a second opening 18.

Figure 2:
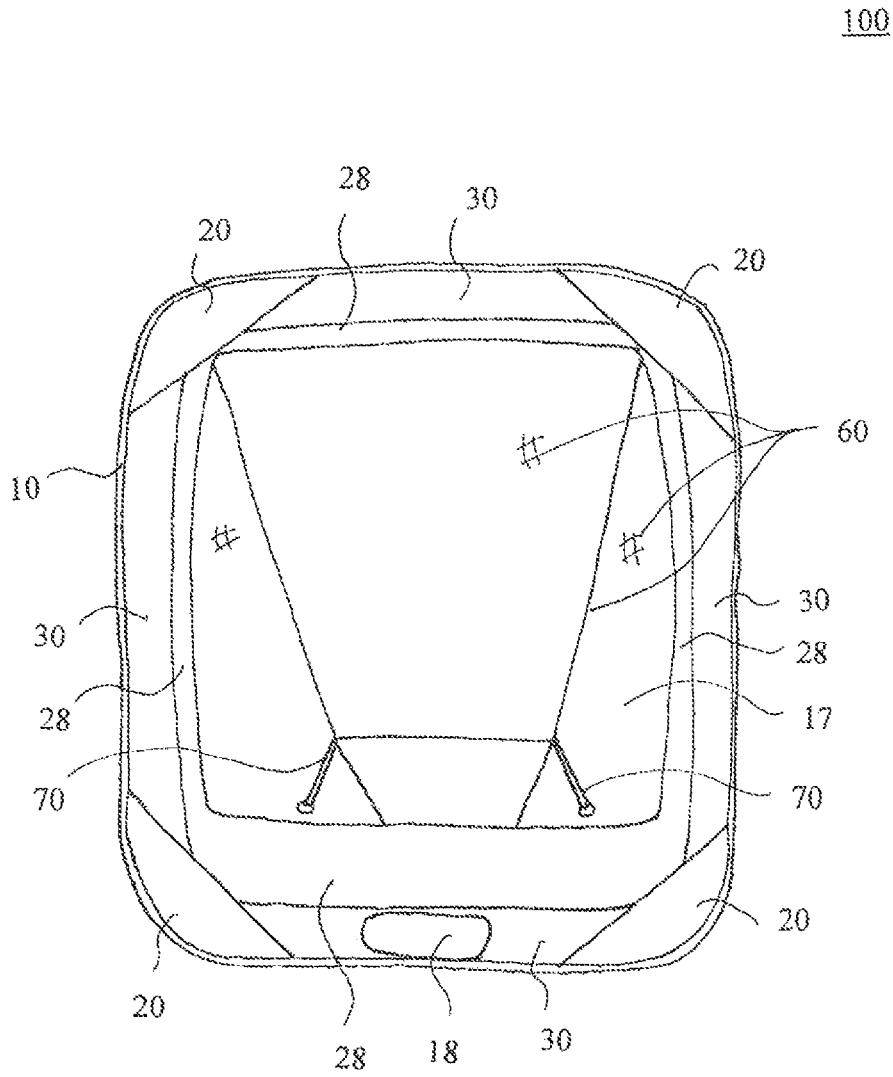
FIG. 2 is a front plan view of the single loop net of FIG. 1.

The loop member 10 comprises a plurality of side straight portions and a plurality of curved corner portions. In FIG. 2, the loop member 10 has four side straight portions and four curved corner portions, forming a rectangle.

The plurality of triangular holders 20 are for holding two neighboring straight portions having one of the plurality of corner portions inbetween so as to form a predetermined angle between the two neighboring straight portions.

The plurality of side straight edge portions 30 are fixed to one of the plurality of side straight portions and disposed between and engaging parts of two neighboring triangular holders 20.

The plurality of triangular holders 20 and the plurality of side straight edge portions 30 make a general shape of the front portion of the single loop net 100. In the illustrated embodiment, the loop member 10 is curbed and held by them so as to make a rectangle.

Each of the one or more propping poles 40 extends from two side straight portions of the loop member 10, and comprises a first end detachably fixed to the side straight portion and a second end detachably fixed to a location on ground. The front portion of the single loop net 100 is installed to lean backward a little bit and is supported by the one or more propping poles 40.

Figure 8:
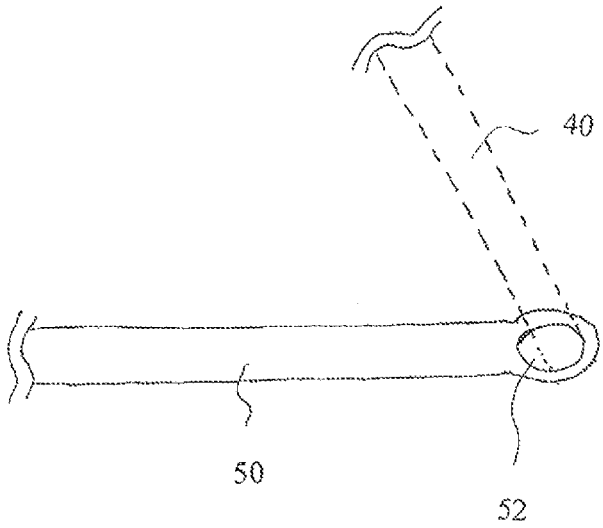
FIG. 8 is a partial view showing a holding strap according to an embodiment of the invention.

Each of the one or more holding straps 50 extends from a lower portion of the loop member 10, and comprises a holding hole 52 at an end thereof as shown in FIG. 8, which is configured to accept the second end of the propping pole 40. In certain embodiments, the holding hole 52 may be configured to accept and hold a peg for fixing them to the ground.

The first opening 17 is enclosed and defined by the triangular holders 20 and the side straight edge portions 30. The first opening 17 is big enough and oriented so as to catch balls flying in from the front side of the single loop net 100.

The catching net 60 covers the first opening 17 from behind and configured to catch balls flying into the first opening 17 from a frontal direction.

Figure 3:
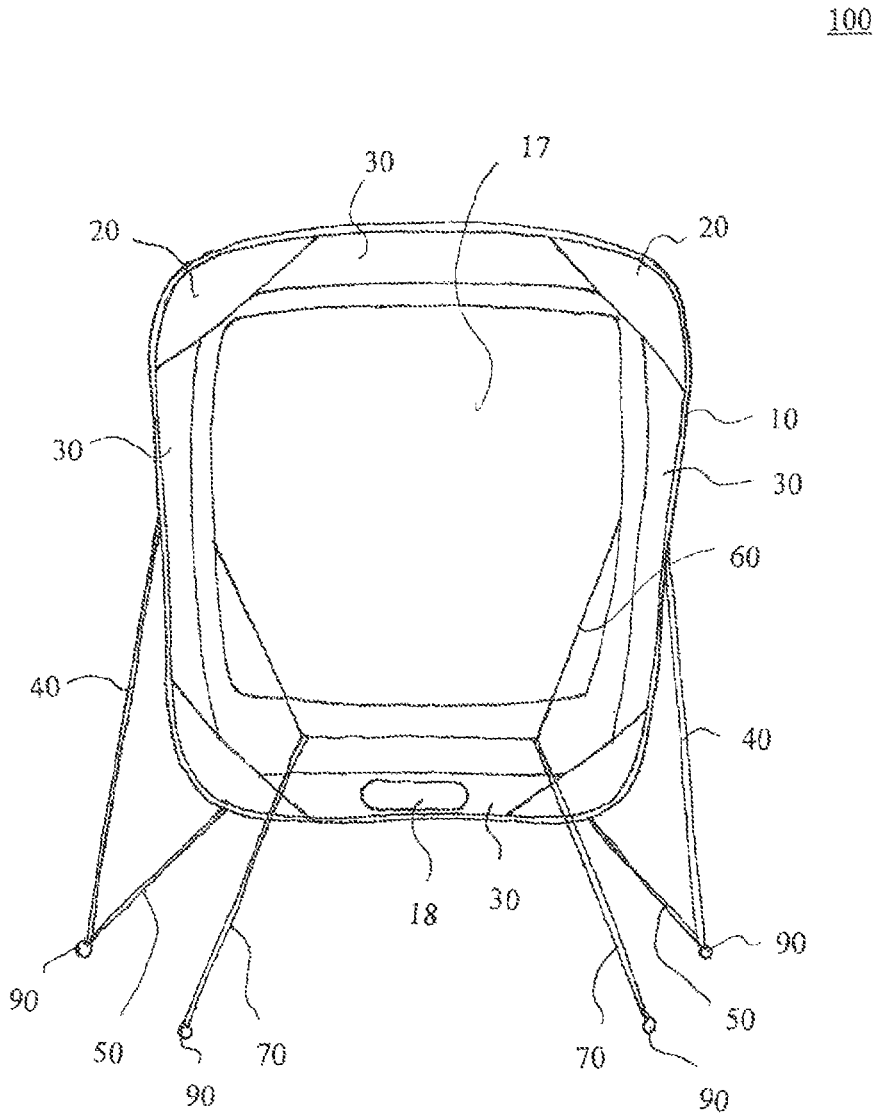
FIG. 3 is a rear plan view of the single loop net of FIG. 1.
Figure 4:
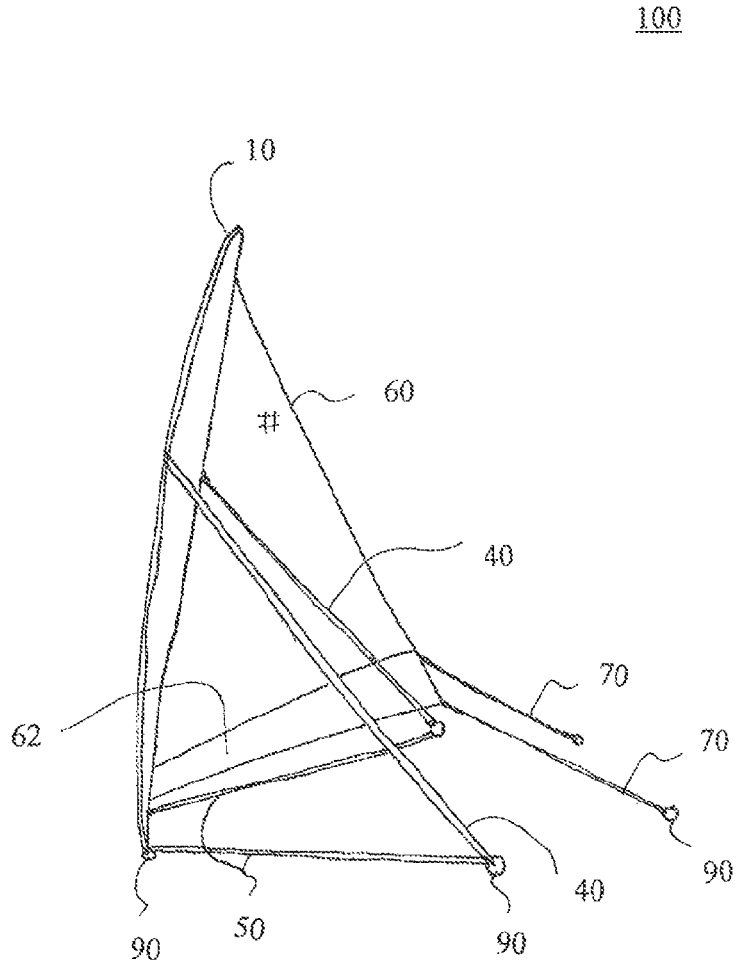
FIG. 4 is a side plan view of the single loop net of FIG. 1.

Each of the one or more net deploying straps 70 comprises a first end fixing to and extending from a portion of the catching net 60 and a second end configured to be fixed a location on the ground as shown in FIGS. 1 and 3. The one or more net deploying straps 70 are configured to pull the catching net 60 toward one or more rear directions so as to provide one or more bottom tilted surfaces 62 along the catching net 60 as shown in FIGS. 1 and 4, and each of the bottom tilted surfaces 62 is tilted toward a frontal direction, such that the caught balls are guided into the first the second opening 18.

The second opening 18 is disposed in a bottom one of the plurality of side straight edge portions 30. The second opening 18 is disposed so as to return balls falling down on the bottom tilted surface 62 toward a frontal direction, and the one or more bottom tilted surfaces 62 of the catching net 60 are configured to collect and guide balls to the second opening 18.

Figure 7:
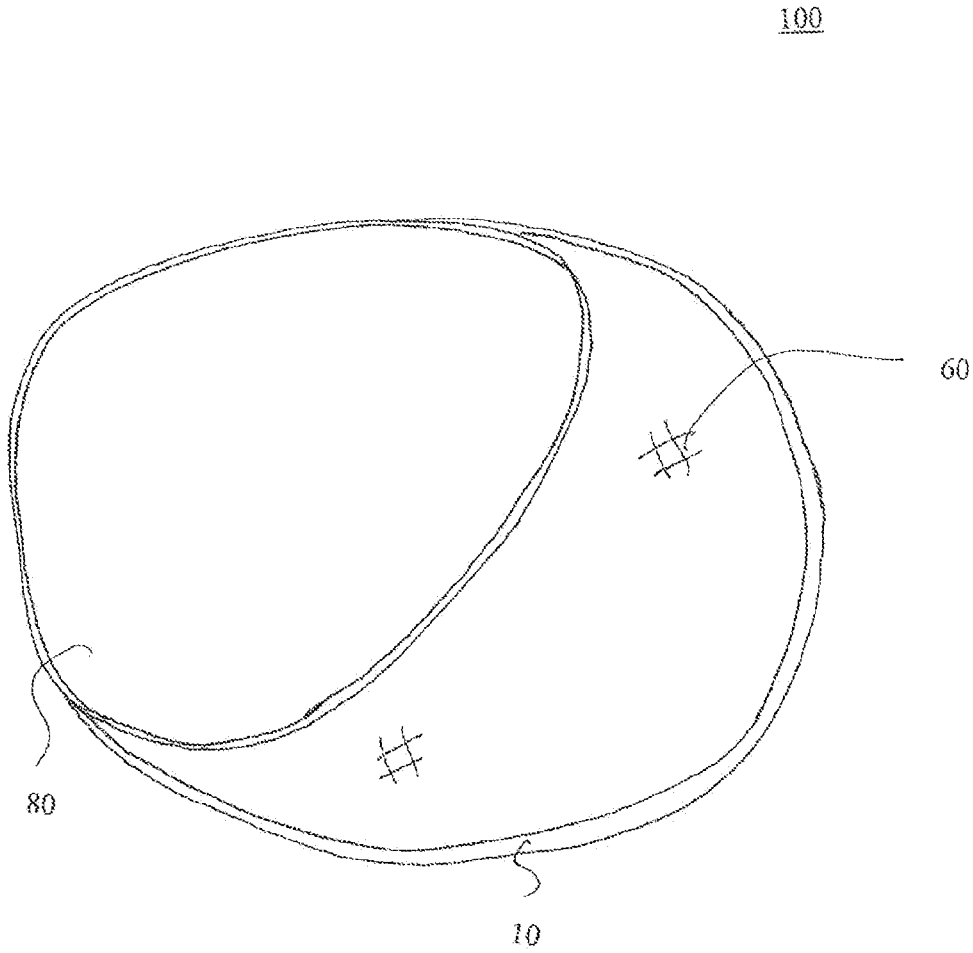
FIG. 7 is a perspective view of a single loop net folded of FIG. 5.

The loop member 10 may be coilable such that the loop member 10 is coiled and packed into a smaller ring as shown in FIG. 7.

The loop member 10 may comprise four side straight portions and four curved corner portions as shown in FIGS. 1-4.

Each of the plurality of triangular holders 20 may be made of fabric. Each of the plurality of side straight edge portions 30 may be made of fabric.

Figure 9:
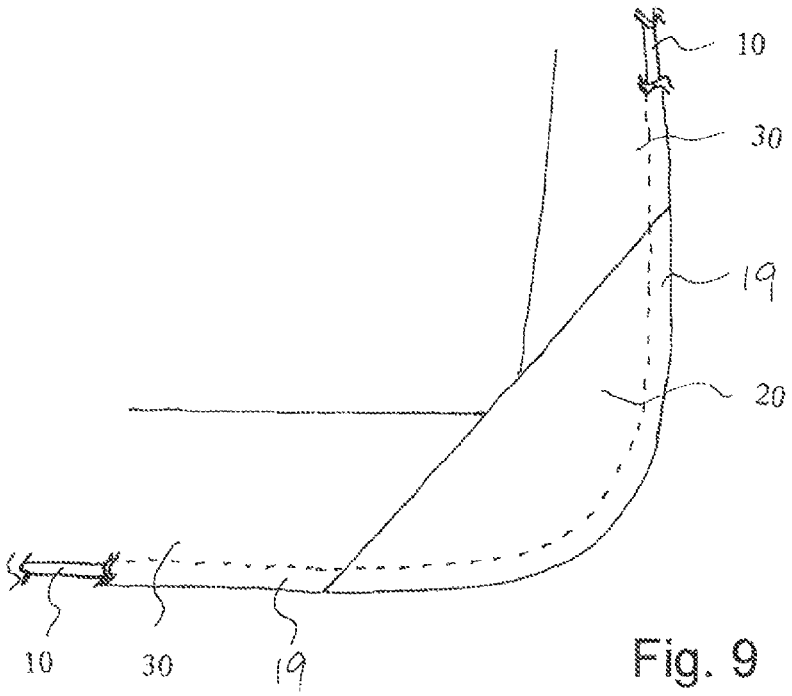
FIG. 9 is a partial view showing a fabric edge hole according to an embodiment of the invention.

The loop member 10 may be embedded in fabric edge holes 19 disposed along edges of the plurality of triangular holders 20 and the plurality of side straight edge portions 30 as shown in FIG. 9.

Figure 10:
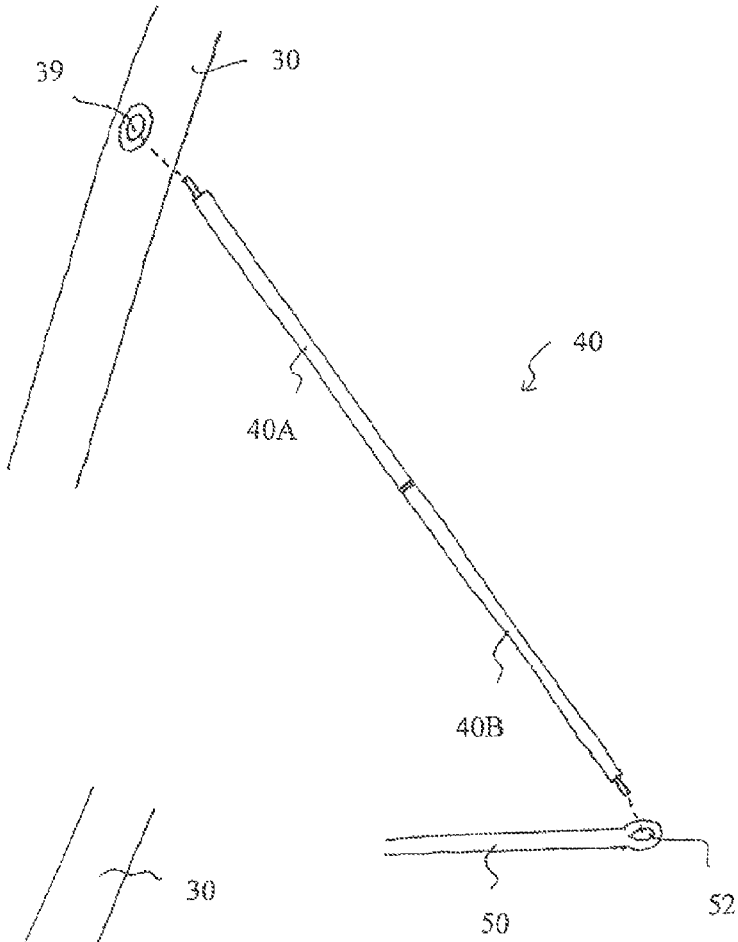
FIG. 10 is a perspective view showing a propping pole according to an embodiment of the invention.

Each of the propping poles 40 may comprise two or more section poles 40A, 40B configured to be connected and detachably fixed to form a propping pole 40 which is configured to support the loop member 10 against gravity as shown in FIG. 10.

The first end of the propping pole 40 may be fixed to a receiving hole 39 provided in one of the plurality of side straight edge portions 30.

Figure 11:
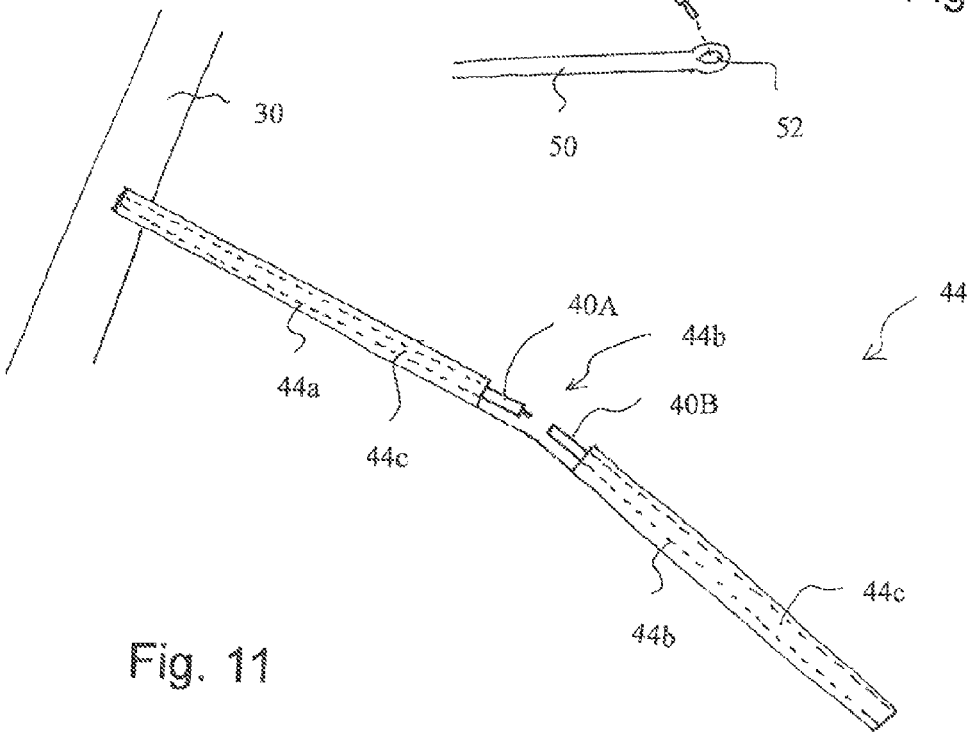
FIG. 11 is a perspective view showing a propping pole wrapping straps according to an embodiment of the invention.

The single loop net may further comprise one or more propping pole wrapping straps 44, and each of the one or more propping pole wrapping straps 44 may comprise first and second ends 44*a*, 44*b*, a supporting hole 44*c*, and a middle cutout 44*d* as shown in FIG. 11.

The first end 44*a* may be fixed to one of the plurality of side straight edge portions 30.

The second end 44*b* may be configured to detachably hold the second end of the propping pole 40.

The supporting hole 44*c* may be configured for receiving the section poles of the propping pole 40.

The middle cutout 44*d* may be configured for receiving the section poles 40A, 40B of the propping pole 40.

The second end of each of the propping pole wrapping straps 44 may be connected to the second end of the corresponding holding straps 50.

The single loop net 100 may further comprise a plurality of pegs 90 for fixing the holding straps 50, propping pole wrapping straps 44, and the net deploying straps 70 to the ground.

The single loop net 100 may further comprise a perimeter portion 28 extends from inner edges of the triangular holders 20 and the side straight edge portions 30, and the perimeter portion 28 may have a color different from the triangular holders 20 and the side straight edge portions 30 so as to make the first opening 17 outstanding visually.

The top and side edge portions 30 of the catching net 60 may be fixed to inner portions of the triangular holders 20 and the side straight edge portions 30.

The bottom edge portions 30 of the catching net 60 may be fixed to a bottom portion of the second opening 18.

The single loop net 100 can be deployed and maintained easily due to the inventive structure.

Figure 5:
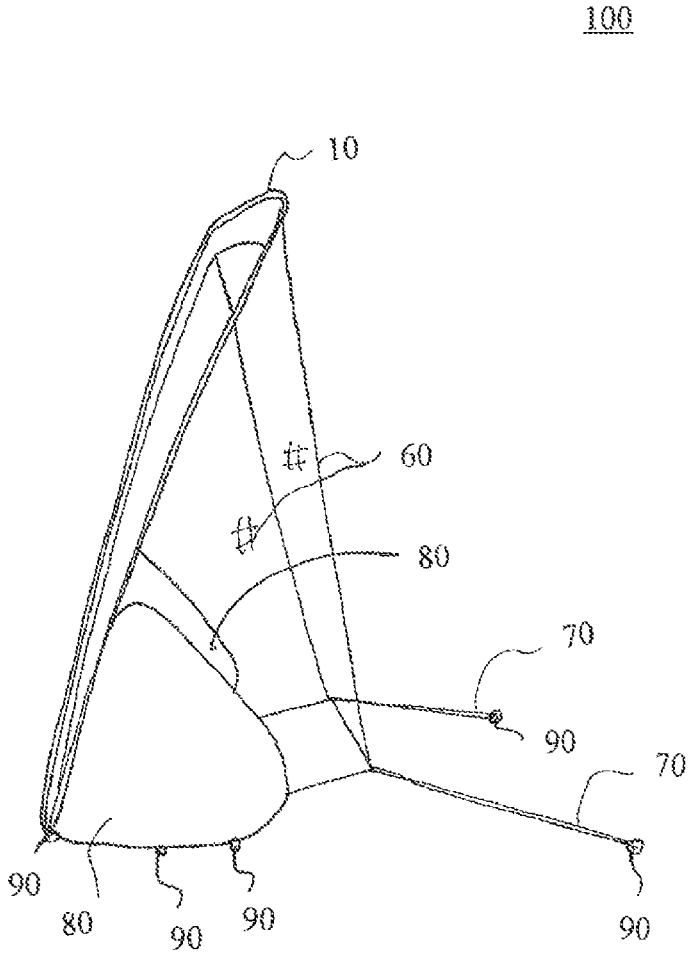
FIG. 5 is a side plan view showing a single loop net according to another embodiment of the invention.
Figure 6:
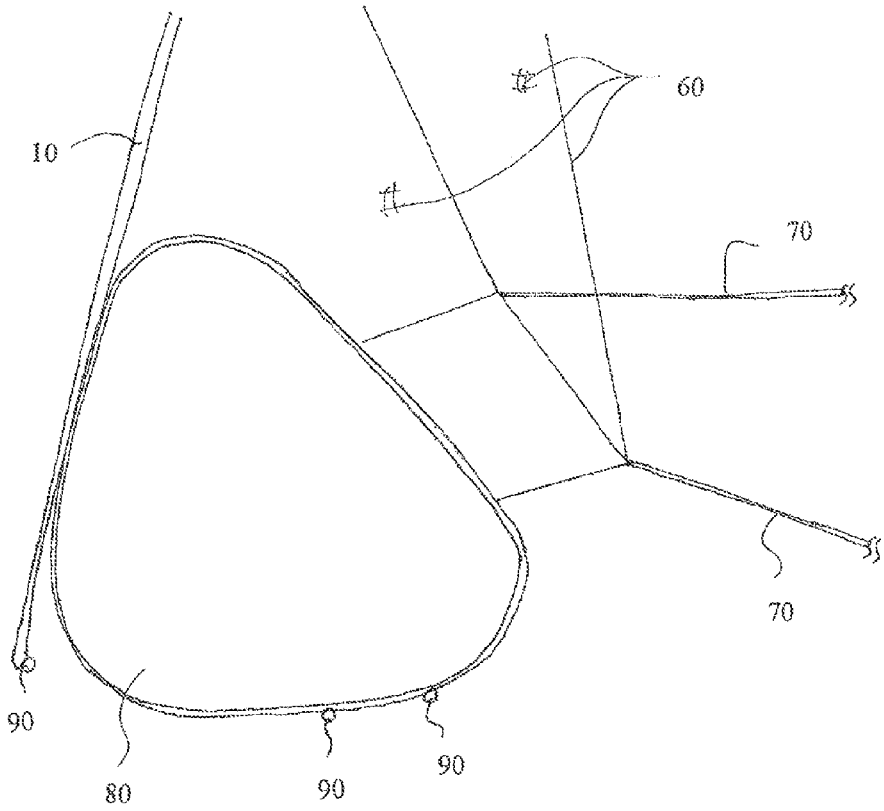
FIG. 6 is a partially exploded view of the single loop net of FIG. 5.

Another aspect of the invention provides a single loop net 100 as shown in FIGS. 5-7.

The single loop net 100 comprises:

a loop member 10 comprising a plurality of side straight portions and a plurality of curved corner portions;

a plurality of triangular holders 20 for holding two neighboring straight portions having one of the plurality of corner portions inbetween so as to form a predetermined angle between the two neighboring straight portions;

a plurality of side straight edge portions 30 fixed to one of the plurality of side straight portions and disposed between and engaging parts of two neighboring triangular holders 20;

two propping discs, each of which comprising a first side portion configured for engaging a lower portion of the loop member 10 and a second side portion configured for being fixed on a ground and propping the single loop net, wherein the first side portion meets the second side portion with a predetermined angle, which is less than a right angle;

a first opening 17 enclosed and defined by the triangular holders 20 and the side straight edge portions 30;

a catching net 60 covering the first opening 17 from behind and configured to catch balls flying into the first opening 17 from a frontal direction;

one or more net deploying straps 70, each of which comprising a first end fixing to and extending from a portion of the catching net 60 and a second end configured to be fixed a location on ground, wherein the one or more net deploying straps 70 are configured to pull the catching net 60 toward one or more rear directions so as to provide one or more tilted surfaces along the catching net 60, wherein the one or more tilted surfaces comprise a bottom tilted surface tilted toward a frontal direction;

a second opening 18 disposed in a bottom one of the plurality of side straight edge portions 30, wherein the second opening 18 is disposed so as to return balls falling down on the bottom tilted surface toward a frontal direction, wherein the one or more tilted surfaces of the catching net 60 are configured to collect and guide balls to the second opening 18.

Each of the two propping discs may be detachably attached to the lower portion of the loop member 10.

Each of the two propping discs may be detachably attached to the lower portion of the loop member 10 with a portion of the side straight edge portion 30.

Each of the two propping discs 80 may be fixed to the ground by a plurality of pegs 90.

Each of the two propping discs 80 may further comprise a third side portion which meets the first and second side portions so as to form a triangle.

Each of the two propping discs 80 may be substantially rigid so as to prop the single loop net on the ground, and wherein the loop member 10 is coilable.

Figure 12:
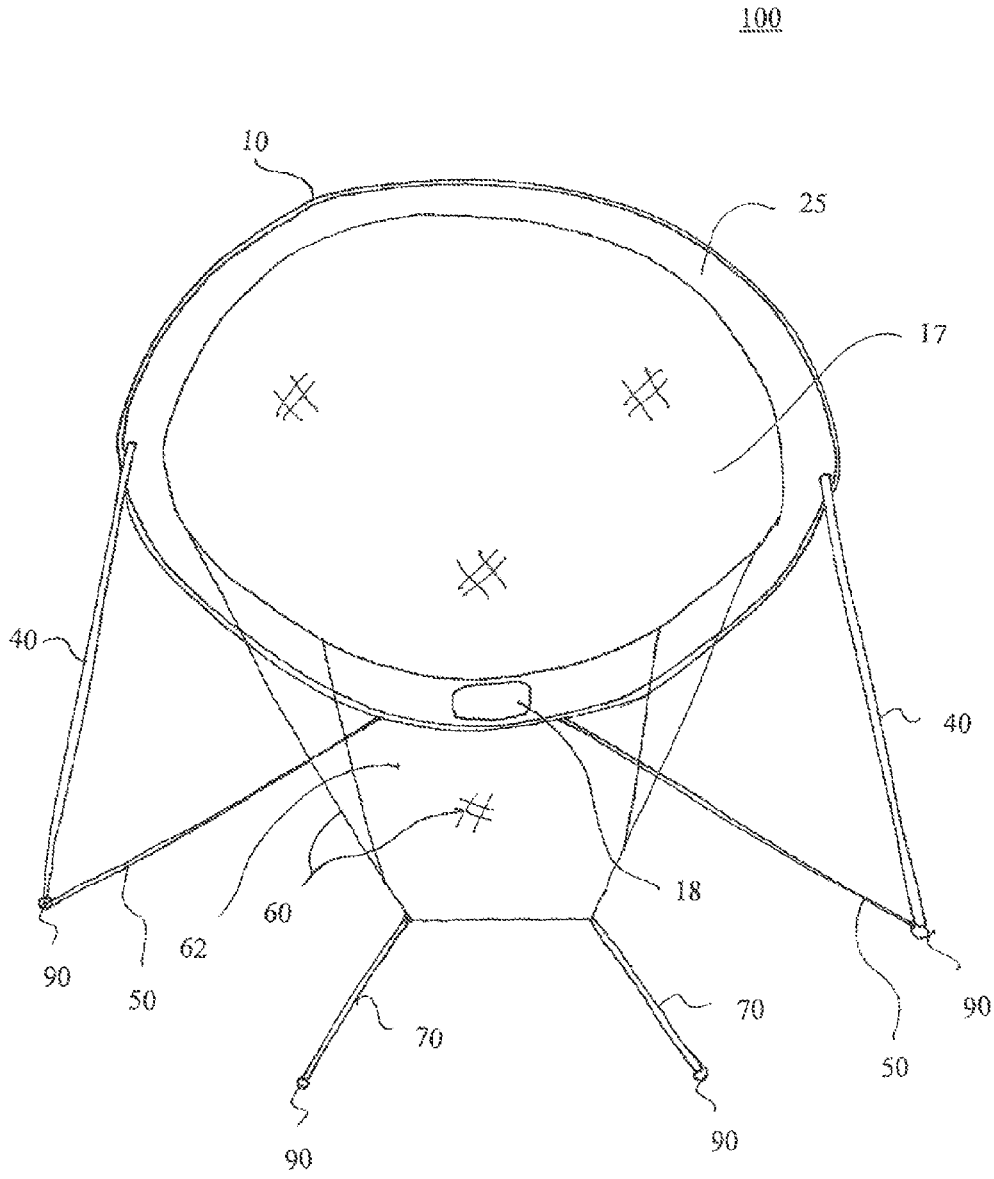
FIG. 12 is a perspective rear view showing a single loop net according to still another embodiment of the invention.

Still another embodiment of the invention provides a single loop 100 net as shown in FIG. 12.

The single loop net 100 comprises a loop member 19, an edge portion 25, one or more propping poles 40, one or more holding straps 50, a first opening 17, a catching net 60, one or more net deploying straps 70, and a second opening 18.

The loop member 10 may have an arbitrary shape such as a circle and polygons. In the illustrated embodiment, the loop member is deployed in a shape of circle.

The edge portion 25 encloses and is fixed to the loop member 10.

Each of the one or more propping poles 40 extends from two side positions of the loop member 10, and each of the one or more propping poles 40 comprises a first end detachably fixed to the side position of the loop member 10 and a second end detachably fixed to a location on ground. The two side positions for fixing the first end of the propping pole 40 are chosen for maximum stability to prop the single loop net 100.

Each of the one or more holding straps 50 extends from a lower portion of the loop member 10, and each of the one or more holding straps 50 comprises a holding hole at an end thereof, which is configured to accept the second end of the propping pole 40.

The first opening 17 is enclosed and defined by the edge portion 25.

The catching net 60 covers the first opening 17 from behind and is configured to catch balls flying into the first opening from a frontal direction.

Each of the one or more net deploying straps 70 comprises a first end fixing to and extending from a portion of the catching net 60 and a second end configured to be fixed a location on ground, and the one or more net deploying straps 70 are configured to pull the catching net 60 toward one or more rear directions so as to provide one or more tilted surfaces along the catching net, and the one or more tilted surfaces comprise a bottom tilted surface 62 tilted toward a frontal direction.

The second opening 18 is disposed in a lower portion of the edge portion, and the second opening 18 is disposed so as to return balls falling down on the bottom tilted surface 62 toward a frontal direction, and the one or more tilted surfaces of the catching net 60 are configured to collect and guide balls to the second opening. The loop member 10 may be coilable.

The loop member 10 may be polygons which may have three, four, five, six, seven, eight, night, ten, eleven, twelve, etc.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A single loop net comprising:

a loop member comprising a plurality of side straight portions and a plurality of curved corner portions;

a plurality of triangular holders for holding two neighboring straight portions having one of the plurality of corner portions inbetween so as to form a predetermined angle between the two neighboring straight portions;

a plurality of side straight edge portions fixed to one of the plurality of side straight portions and disposed between and engaging parts of two neighboring triangular holders;

one or more propping poles, each of which extending from two side straight portions of the loop member, wherein each of the one or more propping poles comprises a first end detachably fixed to the side straight portion and a second end detachably fixed to a location on ground;

one or more holding straps, each of which extending from a lower portion of the loop member, wherein each of the one or more holding straps comprises a holding hole at an end thereof, which is configured to accept the second end of the propping pole;

a first opening enclosed and defined by the triangular holders and the side straight edge portions;

a catching net covering the first opening from behind and configured to catch balls flying into the first opening from a frontal direction;

one or more net deploying straps, each of which comprising a first end fixing to and extending from a portion of the catching net and a second end configured to be fixed at a location on ground, wherein the one or more net deploying straps are configured to pull the catching net toward one or more rear directions so as to provide one or more tilted surfaces along the catching net, wherein the one or more tilted surfaces comprise a bottom tilted surface tilted toward a frontal direction;

a second opening disposed in a bottom one of the plurality of side straight edge portions, wherein the second opening is disposed so as to return balls falling down on the bottom tilted surface toward a frontal direction, wherein the one or more tilted surfaces of the catching net are configured to collect and guide balls to the second opening.

2. The single loop net of claim 1, wherein the loop member is coilable.

3. The single loop net of claim 2, wherein the loop member comprises four side straight portions and four curved corner portions.

4. The single loop net of claim 1, wherein each of the plurality of triangular holders is made of fabric.

5. The single loop net of claim 4, wherein each of the plurality of side straight edge portions is made of fabric.

6. The single loop net of claim 5, wherein the loop member is embedded in fabric edge holes disposed along edges of the plurality of triangular holders and the plurality of side straight edge portions.

7. The single loop net of claim 1, wherein each of the propping poles comprises two or more section poles configured to be connected and detachably fixed to form a propping pole which is configured to support the loop member against gravity.

8. The single loop net of claim 7, wherein the first end of the propping pole is fixed to a receiving hole provided in one of the plurality of side straight edge portions.

9. The single loop net of claim 7, further comprising one or more propping pole wrapping straps, wherein each of the one or more propping pole wrapping straps comprises:

a first end fixed to one of the plurality of side straight edge portions;

a second end configured to detachably hold the second end of the propping pole;

a supporting hole configured for receiving the section poles of the propping pole; and a middle cutout configured for receiving the section poles of the propping pole.

10. The single loop net of claim 9, wherein the second end of each of the propping pole wrapping straps is connected to the end of the corresponding holding strap.

11. The single loop net of claim 10, further comprising a plurality of pegs for fixing the holding straps, propping pole wrapping straps, and the net deploying straps to the ground.

12. The single loop net of claim 1, further comprising a perimeter portion that extends from inner edges of the triangular holders and the side straight edge portions, wherein the perimeter portion has a color different from the triangular holders and the side straight edge portions so as to make the first opening outstanding visually.

13. The single loop net of claim 1, wherein a top and side edge portions of the catching net are fixed to inner portions of the triangular holders and the side straight edge portions.

14. The single loop net of claim 13, wherein a bottom edge portion of the catching net is fixed to a bottom portion of the second opening.

15. A single loop net comprising:

a loop member comprising a plurality of side straight portions and a plurality of curved corner portions;

a plurality of triangular holders for holding two neighboring straight portions having one of the plurality of corner portions inbetween so as to form a predetermined angle between the two neighboring straight portions;

a plurality of side straight edge portions fixed to one of the plurality of side straight portions and disposed between and engaging parts of two neighboring triangular holders;

two propping discs, each of which comprising a first side portion configured for engaging a lower portion of the loop member and a second side portion configured for being fixed on a ground and propping the single loop net, wherein the first side portion meets the second side portion with a predetermined angle, which is less than a right angle;

a first opening enclosed and defined by the triangular holders and the side straight edge portions;

a catching net covering the first opening from behind and configured to catch balls flying into the first opening from a frontal direction;

one or more net deploying straps, each of which comprising a first end fixing to and extending from a portion of the catching net and a second end configured to be fixed at a location on ground, wherein the one or more net deploying straps are configured to pull the catching net toward one or more rear directions so as to provide one or more tilted surfaces along the catching net, wherein the one or more tilted surfaces comprise a bottom tilted surface tilted toward a frontal direction;

a second opening disposed in a bottom one of the plurality of side straight edge portions, wherein the second opening is disposed so as to return balls falling down on the bottom tilted surface toward a frontal direction, wherein the one or more tilted surfaces of the catching net are configured to collect and guide balls to the second opening.

16. The single loop net of claim 15, wherein each of the two propping discs is detachably attached to the lower portion of the loop member with a portion of the side straight edge portion.

17. The single loop net of claim 15, wherein each of the two propping discs is fixed to the ground by a plurality of pegs.

18. The single loop net of claim 15, wherein each of the two propping discs further comprises a third side portion which meets the first and second side portions so as to form a triangle, and wherein each of the two propping discs is substantially rigid so as to prop the single loop net on the ground, and wherein the loop member is coilable.

19. A single loop net comprising:

a loop member;

an edge portion enclosing and fixed to the loop member;

one or more propping poles, each of which extending from two side positions of the loop member, wherein each of the one or more propping poles comprises a first end detachably fixed to the side position of the loop member and a second end detachably fixed to a location on ground;

one or more holding straps, each of which extending from a lower portion of the loop member, wherein each of the one or more holding straps comprises a holding hole at an end thereof, which is configured to accept the second end of the propping pole;

a first opening enclosed and defined by the edge portion;

a catching net covering the first opening from behind and configured to catch balls flying into the first opening from a frontal direction;

one or more net deploying straps, each of which comprising a first end fixing to and extending from a portion of the catching net and a second end configured to be fixed at a location on ground, wherein the one or more net deploying straps are configured to pull the catching net toward one or more rear directions so as to provide one or more tilted surfaces along the catching net, wherein the one or more tilted surfaces comprise a bottom tilted surface tilted toward a frontal direction;

a second opening disposed in a lower portion of the edge portion, wherein the second opening is disposed so as to return balls falling down on the bottom tilted surface toward a frontal direction, wherein the one or more tilted surfaces of the catching net are configured to collect and guide balls to the second opening.

20. The single loop net of claim 19, wherein the loop member is coilable.

* * * * *